United States Patent [19]

Aoki

[11] 4,310,188

[45] Jan. 12, 1982

[54] MAGNETIC SWITCH FOR ATTRACTIVE LATCH

[76] Inventor: Yoshihiro Aoki, No. 9-16, 2 chome, Hanahata Adachi-ku, Tokyo, Japan

[21] Appl. No.: 90,655

[22] Filed: Nov. 2, 1979

[51] Int. Cl.[3] ..... E05C 17/56

[52] U.S. Cl. ..... 292/251.5

[58] Field of Search ..... 292/144, 201, 251.5

[56] References Cited

U.S. PATENT DOCUMENTS

| | | | |
|---|---|---|---|
| 3,426,166 | 2/1969 | Canceill | 292/251.5 |
| 3,431,002 | 3/1969 | Melgaard | 292/251.5 |
| 4,010,967 | 3/1977 | Renteria, Jr. | 292/251.5 |
| 4,021,891 | 5/1977 | Morita | 292/251.5 X |

*Primary Examiner*—Richard E. Moore

*Attorney, Agent, or Firm*—Wenderoth, Lind & Ponack

[57] ABSTRACT

A magnetic switch for attractive latch which has an attractive latch including a permanent magnet with a hole in its center, in which a ferromagnetic plate being fixed at its one side surface and a ferromagnetic plate, which has a projection in its center, being installed freely detachable at the other side, and the projection is set to be freely movable inside of the center hole of the permanent magnet, outside surface of the fixed permanent magnet being provided with a switch, which has an insulator, a fixed piece, a movable piece, and an insulator pin, moves corresponding to engaging or disengaging motion of the ferromagnetic plate, and the insulator pin is attached at the center of movable piece and is engaged or disengaged with the projection in the center hole of the permanent magnet.

6 Claims, 16 Drawing Figures

MAGNETIC SWITCH FOR ATTRACTIVE LATCH

BACKGROUND OF THE INVENTION

1. Field of the Invention

The present invention relates to a magnetic switch for attractive latch, specifically relates to a magnetic switch for attractive latch which includes a permanent magnet with a hole in its center, a ferromagnetic plate being fixed to its one side surface and a ferromagnetic plate being installed detacheable freely at the other side surface and a switch is installed to the fixed ferromagnetic plate.

2. Description of the Prior Art

Hitherto there were proposed and put into practice many types of attractive latch having a construction having a permanent magnet and ferromagnetic substance for attractive action, but they could not assure the engage state of attractive latch, so that it was very inconvenient for usage.

SUMMARY OF THE INVENTION

An object of the present invention is to provide a attractive latch which discharges the desired function and has the said defects.

In order to attain the object, the magnetic switch for attractive latch according to the present invention includes a permanent magnet with a hole in its center, a ferromagnetic plate being fixed to its one side surface and a ferromagnetic plate, which has a projection in its center, being installed freely detacheable at the other side surface, the projection can be moved freely inside of the center hole in the permanent magnet, is characterized that outside surface of the fixed ferromagnetic plate being provided with a switch, which has an insulator, a fixed piece, a movable piece and an insulator pin, moves corresponding to engaging to disengaging motion of the ferromagnetic plate. The preferred embodiment of the present invention will be described as follows.

DESCRIPTION OF THE PREFERRED EMBODIMENTS

Figure 1:
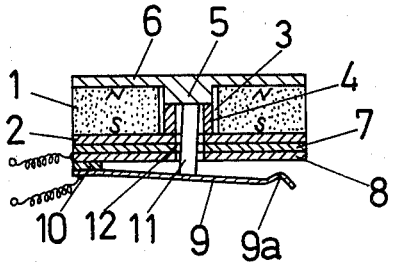
FIG. 1 shows a sectional view of a magnetic switch for attractive latch according to the present invention, FIG. 2 showing a plan view of the magnetic switch for attractive latch according to the present invention, each of FIGS. 3–9 and FIGS. 11–16 showing sectional view of other embodiment of the magnetic switches for attractive latch according to the present invention respectively.
Figure 2:
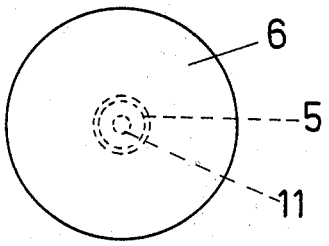

FIG. 1 and FIG. 2 show a magnetic switch for attractive latch, in which a ferromagnetic plate 2 is fixed on one side surface of a hollow cylindrical magnet 1 (which is magnetized at its axial direction), a ferromagnetic material made tube 4 being inserted inside wall of center hole 3 of the hollow cylindrical magnet 1, a ferromagnetic plate 6 with a projection 5 in its center being installed on other side surface of the hollow cylindrical magnet 1 detacheably, the projection 5 being freely got in or got out from inside of the center hole 3; and in which a switch includes a fixed piece 8 made by conductive material, a movable piece 9 made by a elastic conductive material is installed to the ferromagnetic plate 2 with an insulator 7.

The movable piece 9 is fixed at its one end to the fixed piece 8 through an insulator 10, the other end **9*a*** being bent and acts as a contact point.

An insulator pin 11 planted in the midst of the movable piece 9 contacts to the projection 5 of the ferromagnetic plate 6 through the hole 12 which is perforated in the fixed plate 8, the insulator plate 7, the ferromagnetic plate 2, and the hole of tube 4.

When the freely detacheable ferromagnetic plate 6 is attracted to the hollow cylindrical magnet 1, the projection 5 presses the insulator pin 11 and the bent end **9*a* of the movable piece 9 is separated from the fixed piece 8. While, when the ferromagnetic plate 6 is separated from hollow cylindrical magnet 1, the bend end 9*a* of the movable piece 9 contacts to the fixed piece 8 by its elasticity. Accordingly, the switch having a fixed piece 8 and a movable piece 9 is operated by the contacting or separating motion of the ferromagnetic plate 6. Therefore, if one attaches the magnetic switch to the latch part of some bags and the like, and furthermore the magnetic switch is connected to a alarm circuit, it is possible to have a alarm sound when the bag is opened. Beside, in the attractive latch of the said embodiments, the magnetic flux from the N pole of the hollow cylindrical magnet 1 pass through the ferromagnetic plate 6, the projection 5, the tube 4, and the ferromagnetic plate 2 arrives to the opposite S pole, so that the magnetic flux concentrate at the projection 5 and tube 4**, it is possible to get very strong attractive force.

Figure 3:
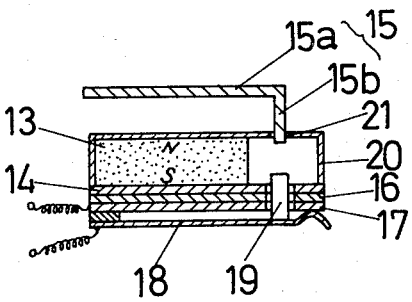

An embodiment as shown in FIG. 3 indicates that the attractive latch which has a ferromagnetic plate 14 is fixed to one side surface of a magnetic plate 13, installed a ferromagnetic plate 15 being installed to other side surface detacheable freely, the magnetic flux from N pole of the magnetic plate 13 passing through the horizontal part **15*a* to vertical part 15*b* of magnetic plate 15, then passing through the ferromagnetic plate 14 from vertical part 15*b* and that arrive to the S pole of the magnetic plate 13. At the same time as shown in the embodiment in FIG. 1 and FIG. 2, if it is applied a switch having a fixed piece 17 and a movable piece 18 positioned upon an insulating plate 16, the tip point of an insulator pin 19 which is planted at movable piece 18 contacts with the lower end of the vertical part 15*b* of the ferromagnetic plate 15. At one surface of a cover 20 which covers the magnetic plate 13 has a hole 21 where the vertical part 15*b* of the ferromagnetic plate 15** so as to be got in or got out.

Figure 4:
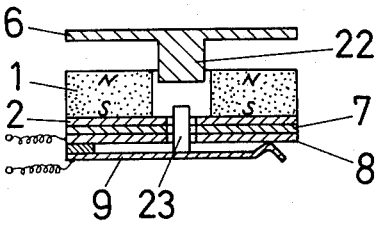

An embodiment as shown in FIG. 4 indicates that a magnetic switch for attractive latch which has such a style that length of projection 22 is the same amount of the thickness of the hollow cylindrical magnet 1, and length of insulator pin 23 is shorter than the length of the insulator pin 11 in FIG. 1, but the other construction parts are all the same as that of the embodiment of FIG. 1.

Figure 5:
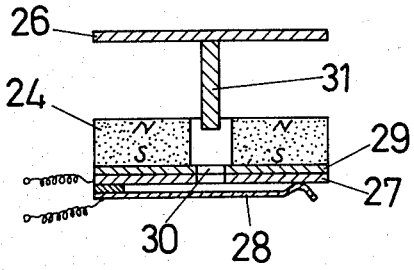

An embodiment shown in FIG. 5 indicates that a magnetic switch for attractive latch has a freely detacheable ferromagnetic plate 26 at one side surface of a hollow cylindrical magnetic 24 and a switch which has a fixed piece 27, a movable piece 28 positioned upon the insulating plate 29 at its other side surface, and that the movable piece 28 is operated by the motion of an insulator pin 31 which moves through the hole 30 perforated in the insulating plate 29 and the fixed piece 27.

Figure 6:
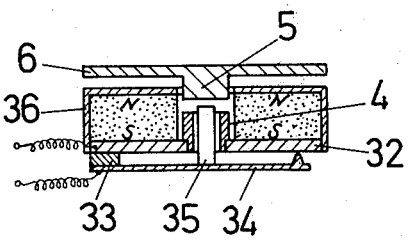

An embodiment as shown in FIG. 6 indicates that a magnetic switch for attractive latch has a movable piece 34 positioned upon the insulator 33 which is placed at the outer surface of a fixed ferromagnetic plate 32, in which a ferromagnetic plate and a fixed piece being assembled in one body, and that an insulator pin 35 planted at the center of the movable piece 34 elongates to the ferromagnetic plate 6 attached detacheable freely (to the hollow cylindrical magnet) through the fixed ferromagnetic plate 32 and tube 4. Referring number 36 shows a cover for using decoratively.

Figure 7:
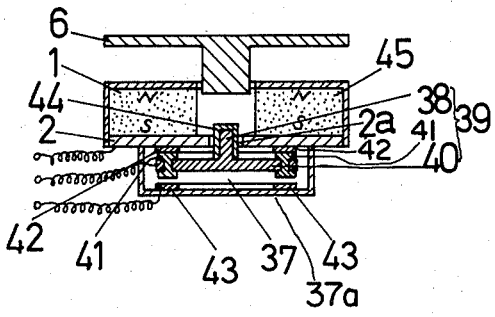

An embodiment as shown in FIG. 7 indicates that a magnetic switch for attractive latch has the attractive latch having the same construction as shown in FIG. 4, and a small chamber 37 which is placed at the outer surface of the ferromagnetic plate 2 fixed on the hollow cylindrical magnet 1, in which a movable piece 39 made by ferromagnetic material which can move up and down freely and has a projection 38 projected to the side of the hollow cylindrical magnet 1 through a hole 2*a* of the ferromagnetic plate 2. And a contact piece 41 is installed to each of the upper and lower surfaces of a base plate 40 of the movable piece 39, a contact piece 42 being installed at the outer surface of the ferromagnetic plate 2 and a contact piece 43 is installed at the upper surface of bottom plate of a small chamber 37. Referring number 44 shows an insulating cover which covers the projection 38 and referring number 45 shows an insulating cover which covers the hollow cylindrical magnet 1. In this embodiment, when the movable piece 39 is attracted to the hollow cylindrical magnet 1, and if the ferromagnetic plate 6 is separated the switch gets on by the contact piece 41 and the contact piece 42, on the other hand, if the ferromagnetic plate 6 is attracted, the magnetic switch gets on by the contact piece 41 and contact piece 43.

Figure 8:
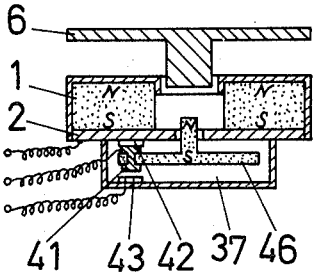

An embodiment as shown in FIG. 8 indicates that a magnetic switch for attractive latch has a movable piece 46 made by permanent magnet. Each polarity of the magnet is as shown in the figure. The on-off action of the switch is all the same as the aforementioned description.

Figure 9:
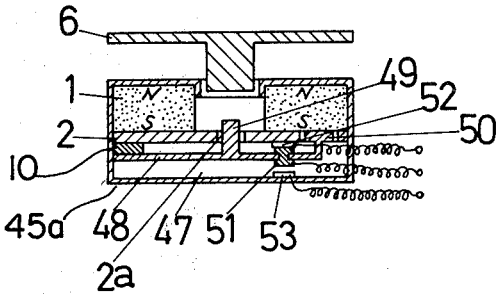
Figure 10:
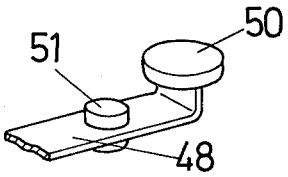
FIG. 10 is an enlarged perspective view of an embodiment of the magnetic switch for attractive latch as shown in FIG. 9.

Each embodiment as shown in FIG. 9 and FIG. 10 indicates that a magnetic switch for attractive latch has a small chamber 47 at outer side of ferromagnetic plate 2 fixed to the hollow cylindrical magnet 1, a cantilever type moving piece 48 being installed inside of the small chamber 47, a pin 49, which is planted at the center of the movable piece 48, being projected into the hollow cylindrical magnet 1 through the hole 2*a* of the ferromagnetic plate 2, a small disc 50 made by ferromagnetic material being provided at one end of the movable piece 48, a part in the ferromagnetic plate 2 being cut off almost same shape of that small disc, and that the magnetic switch for attractive latch is constructed by a switch having a contact piece 51 of the movable piece 48 and a contact piece 52 installed at the outer surface of the ferromagnetic plate 2, and further a switch having the contact piece 51 and a contact piece 53 installed at the bottom of the small chamber 47. In this embodiment, if the ferromagnetic plate 6 is separated from hollow cylindrical magnet 1, then the small disc 50 is attracted by the hollow cylindrical magnet 1 and the contact pieces 51, 52 contact, on the contrary, the ferromagnetic plate 6 is attracted to the hollow cylindrical magnet 1, then the pin 49 is pressed, so that the contact piece 51 and contact piece 53 contact.

Figure 11:
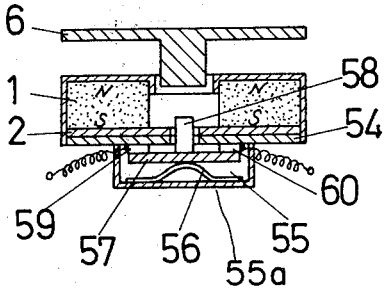

An embodiment as shown in FIG. 11 indicates that a magnetic switch for attractive latch has a insulated plate 54 sticked to the outside surface of the ferromagnetic plate 2, a small chamber 55 being installed outside surface of a insulated plate 54, a movable piece 57 being situated constantly at upper position of the small chamber 55 by the spring force of spring 56, a central pin 58 planted at the movable piece 57 being projected to inside of hollow cylindrical magnet 1, so that it is enabled to conduct or cutting off by the connection or disconnection action that two contact pieces 59, 60, which is installed outside surface of aforementioned insulating plate 54, are connected or disconnected to the movable piece 57.

Figure 12:
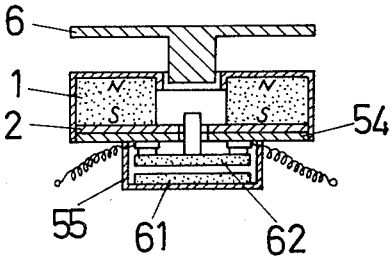

An embodiment as shown in FIG. 12 indicates a magnetic switch for attractive latch installed a permanent magnet 61 at the bottom of small chamber 55, instead of the spring 56 shown in FIG. 11 and a movable piece 62 made by permanent magnetic material enabled to be positioned constantly at the upper part of the small chamber. In this embodiment, the permanent magnet 61 and the movable piece 62 faced each other with the same magnetic pole so that there a repulsive force is generated, on the other hand, the movable piece 62 and the hollow cylindrical magnet 1 is faced with different magnetic pole, so that an attractive force is generated.

Figure 13:
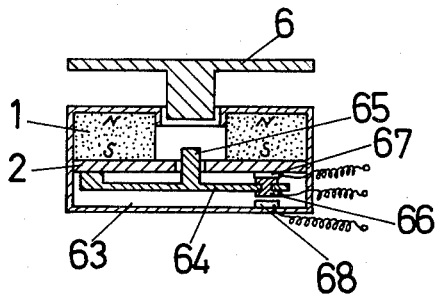

An embodiment as shown in FIG. 13 indicates a magnetic switch for attractive latch, in which a cantilever type movable piece 64, made by synthetic resin, is installed inside of a small chamber 63 which is situated at outside of fixed ferromagnetic plate 2, a central projection 65 being inserted into the hollow cylindrical magnet 1 through the center hole of fixed ferromagnetic plate 2, each of contact pieces 67, 68 being installed respectively at the outer surface of ferromagnetic plate 2 and the bottom of the small chamber 63 opposed to a contact piece 66 at the edge of the movable piece 64. If the ferromagnet 6 is separated from hollow cylindrical magnet, the contact piece 66 and contact piece 67 contacts by the elastic force of the movable piece 64, and if the ferromagnetic plate 6 is attracted to hollow cylindrical magnet, the contact piece 66 and the contact piece 68 contact.

Figure 14:
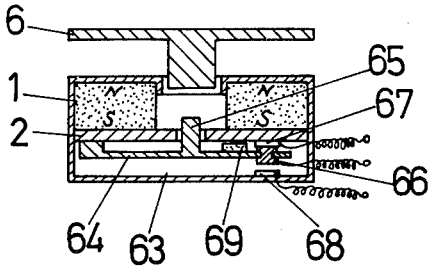

An embodiment as shown in FIG. 14 indicate a magnetic switch for attractive latch, in which a permanent magnet 69 is installed to attract mutually with hollow cylindrical magnet 1 at the upper surface of contact point end of the movable piece 64 for the purpose of having a assured return of the movable piece 64.

Figure 15:
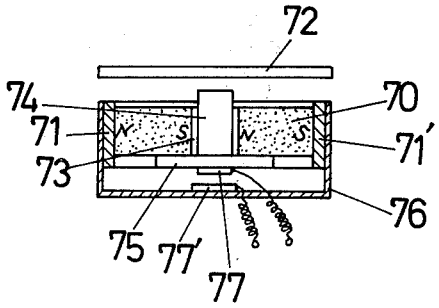

An embodiment as shown in FIG. 15 indicates a magnetic switch for attractive latch, in which two fixed ferromagnetic plates 71, 71' are fixed at both poles of a plate shaped permanent magnet 70 a ferromagnetic plate 72 being attached detacheable freely at one end of two ferromagnetic plate 71, 71'. A pin 74 is inserted into a hole perforated at the center of the plate shaped permanent magnet 70, a ferromagnetic plate 75 attracted to the side wall of the plate shaped permanent magnet 70 being fixed at one end of pin 74, and therefore a switch is constructed with contact pieces 77, 78 installed respectively at the outside of ferromagnetic plate 75 and the bottom of the cover 76.

In this embodiment, when the ferromagnetic plate 72 is attracted to the ferromagnetic plates 71, 71', the switch gets on, because of the contact pieces 77 and 77' contact by the pressing action of the ferromagnetic plate 72 to the pin 74, and when the ferromagnetic plate 72 is separated, the switch gets off by the action of the ferromagnetic plate 75 attracted to the plate shaped permanent magnet 70, and therefore the contact pieces 77, 77' are disconnected.

Figure 16:
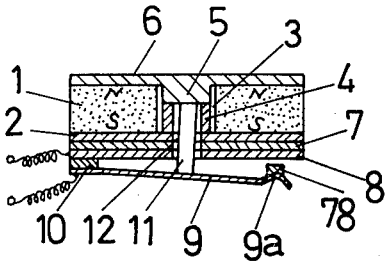

An embodiment as shown in FIG. 16 indicates a magnetic switch for attractive latch, in which a pressure conductive rubber 78 is attached to the contact point 9*a* of a movable piece 9, and therefore make connection and disconnection with the fixed piece 8 through the aforementioned pressure conductive rubber 78.

The said pressure conductive rubber 78 is a pressure sensitive resistor made by the base of the combination of a polymer having the adhesive elasticity and some conductive particles, having a switching function by rapid resistance changing quality from insulating state (several ten MΩ) to conducting state (several ten Ω) corresponding to the amount of pressure applied. Using this material, there are some merits that it prevents the wear and tear having no contact action when switch gets on or off, and furthermore has the function of dust proof.

As shown in each embodiments as above mentioned, by using the magnetic switch for attractive latch according to the present invention, one can get the bag or trunk generating alarm when the bag is opened, alarm circuit being constructed, and furthermore, the opening and closing action of opening part of bag can be done surely. This means that the magnetic switch for attractive latch according to the present invention has superior construction, function and advantages compared with the conventional attractive latch.

What is claimed is:

1. A magnetic latch and detector switch in combination comprising:

a magnetic latch means, said latch means including:
- a permanent magnet having a bore therethrough; and
- a ferromagnetic latch plate having a projection which extends into said bore when said latch is in a first position whereby it is magnetically attached to one end of said magnet; and a detector switch means, said switch means including:
- an insulation plate having one side connected to the other end of said magnet and having a hole therethrough which corresponds to said bore;
- a contact element fixed to said insulation plate at a side opposite said magnet and having an aperture therethrough which corresponds to said hole;
- a movable contacting piece;
- a resilient insulator positioned between and respectively connected to said element and said piece such that one end of said piece is biased inward and toward said contact element; and
- said piece having a dielectric pin inwardly extending from said piece and projecting through said aperture and hole and into said bore, said piece being of a length whereby when said latch plate is in said first position said pin abuts said latch plate projection and forces said piece outward and away from said contact element and when said latch plate is unattached to said magnet said piece is biased inward and into contact with said contact element.

2. The combination as claimed in claim 1, in which a ferromagnetic end plate is interposed between said magnetic and said insulation plate, and said end plate has a cavity therethrough for allowing said pin to project into said bore.

3. The combination as claimed in claim 1, in which said piece has a pressure conductive rubber member fixed to said piece at an area of contact between said piece and said element.

4. A magnetic latch and detector switch in combination comprising:

a magnetic latch means, said latch means including:
- a permanent magnet having a bore therethrough;
- a ferromagnetic latch plate magnetically attached to one end of said magnet and having a projection which extends into said bore when said latch is in a first position; and
- a ferromagnetic end plate having one side connected to the other end of said magnet and having a hole therethrough which corresponds to said bore;

an electronic detector switch means, said switch means including;
- a first contact means positioned on said end plate on a side opposite said magnet;
- a hollow bridge having ends which are connected to said end plate, and a portion of said bridge extends outwardly from said end plate to define a chamber between said bridge outwardly extending portion and said end plate;
- a second contact means positioned on said bridge outwardly extending portion and within said chamber;
- a movable ferromagnetic contacting piece positioned within said chamber, said piece having a dielectric pin inwardly extending from said piece and projecting through said hole and into said bore, said piece being of a length whereby when said latch plate is in said first position said pin abuts said latch plate projection and forces said piece outward and into contact with said second contact means, and when said latch plate is unattached to said magnet, the magnetic force of said magnet draws said piece inward and into contact with said first contact means.

5. The combination as claimed in claim 4, in which said ferromagnetic contacting piece is magnetized.

6. The combination as claimed in claim 1 in which at least a portion of said piece is magnetized whereby when said latch plate is unattached to said magnet, the magnetized portion of said piece draws said piece inward and into contact with said contact element.

* * * * *